United States Patent [19]

Donnelly et al.

[11] 4,154,497

[45] May 15, 1979

[54] STRIPLESS ELECTRICAL CONTACT

[75] Inventors: Robert W. Donnelly, Basingstoke; Allan F. Jones, Liphook, both of England

[73] Assignee: International Standard Electric Corporation, New York, N.Y.

[21] Appl. No.: 869,509

[22] Filed: Jan. 16, 1978

Related U.S. Application Data

[63] Continuation of Ser. No. 776,598, Mar. 11, 1977, abandoned.

[30] Foreign Application Priority Data

Mar. 18, 1976 [GB] United Kingdom ..... 10927/76

[51] Int. Cl.[2] ..... H01R 13/38

[52] U.S. Cl. ..... 339/97 R; 339/260

[58] Field of Search ..... 339/97–99, 339/258 R, 260, 261

[56] References Cited

U.S. PATENT DOCUMENTS

| | | | |
|---|---|---|---|
| 2,534,881 | 12/1950 | Schroeder | 339/97 R |
| 2,689,337 | 9/1954 | Burtt et al. | 339/275 T |
| 3,422,391 | 1/1969 | Thompson | 339/97 R |
| 3,825,881 | 7/1974 | Wigby | 339/97 R |
| 3,879,099 | 4/1975 | Shaffer | 339/99 R |
| 4,019,801 | 4/1977 | Hoffman | 339/98 |
| 4,032,215 | 6/1977 | Jarmofsky et al. | 339/258 R |
| 4,040,703 | 8/1977 | Shaffer | 339/99 R |

*Primary Examiner*—Joseph H. McGlynn

*Attorney, Agent, or Firm*—Thomas L. Peterson

[57] ABSTRACT

A stripless contact has its wire-terminating portion formed by two arms bent outwards and inwards to form jaws. The jaws each have a notch. To terminate a wire, the wire is pushed into the hole formed by the notches and the jaws are crimped together so that the jaws rupture the insulation and grip and make electrical contact with the wire.

1 Claim, 13 Drawing Figures

FIG. 1.
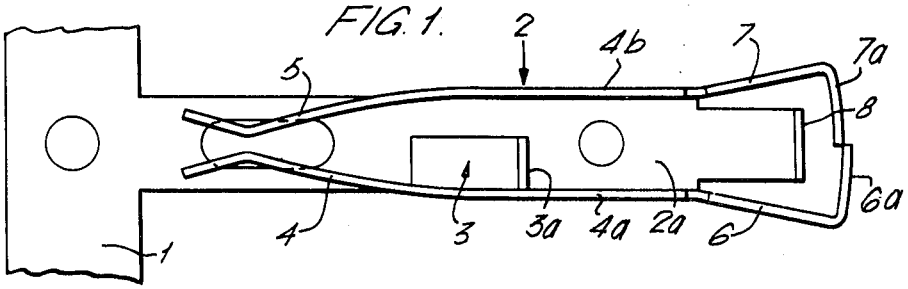
FIG. 2.
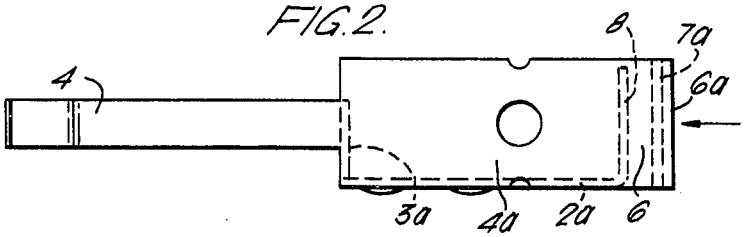
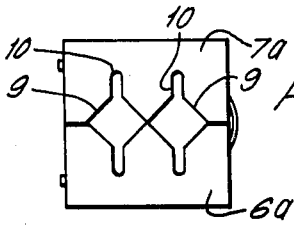
FIG. 3.
FIG. 4.
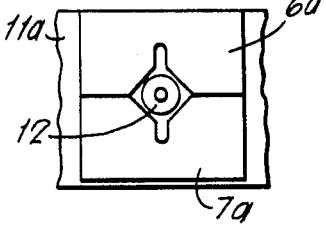
FIG. 5.
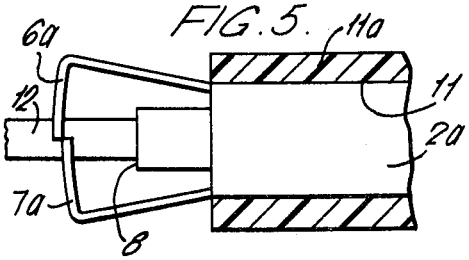
FIG. 6.
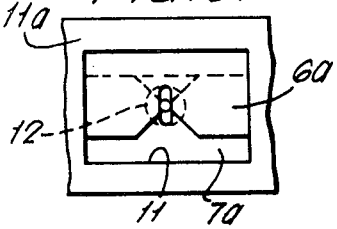
FIG. 7.
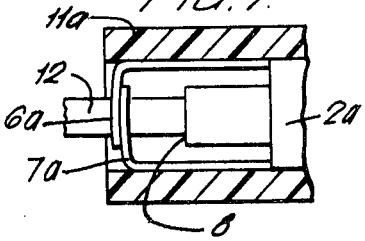

STRIPLESS ELECTRICAL CONTACT

This is a continuation of application Ser. No. 776,598, filed Mar. 11, 1977, now abandoned.

BACKGROUND OF THE INVENTION

The present invention relates generally to electrical contacts and, more particularly, to stripless electrical contacts.

Stripless electrical contacts are well known in the art. The following U.S. patents disclose a variety of such contacts which are relevant to the present invention; U.S. Pat. Nos. 2,702,895; 3,233,206; 3,422,391; 3,553,631; and 3,879,099. The purpose of the present invention is to provide a novel stripless contact which is simple in structure, inexpensive to manufacture, easy to terminate to an insulated wire, and provides a reliable electrical connection to the wire.

SUMMARY OF THE INVENTION

According to a principal aspect of the invention, there is provided an electrical contact formed from metallic strip and having a wire-receiving portion at one end. A portion of the contact forward of the wire-receiving portion is generally U-shaped. A pair of arms extend rearwardly from the sidewalls of the U and at least one arm is splayed outwards. The end portions of the arms are bent inwards. The end portions of the two arms each have a notch so that the two end portions form jaws with the notches defining an aperture. To terminate an insulated wire, the wire is pushed into the aperture and thus between the jaws, whereafter the end portions are crimped together so that the edges of the notches rupture the insulation on the wire so as to make electrical contact with the wire.

BRIEF DESCRIPTION OF THE DRAWINGS

FIG. 1 is a plan view of a contact embodying the invention shown joined to a bandolier;

FIG. 2 is a side view of the contact of FIG. 1 separated from the bandolier;

FIG. 3 is an end view, as seen looking in the direction of the arrow in FIG. 2, of the contact of FIG. 2;

FIGS. 4 to 7 show schematically how a wire is terminated to a contact embodying the invention;

DESCRIPTION OF THE PREFERRED EMBODIMENT

Figure 8:
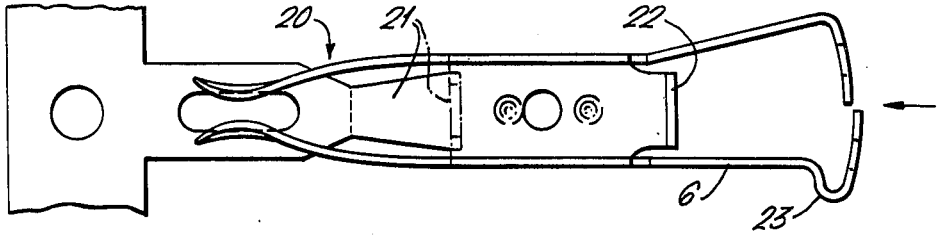
FIGS. 8 and 9 are, respectively, plan and side views of a second contact embodying the invention.

The contact of the present invention is of the so-called stripless type. That is, when the contact is terminated to a wire, the insulation thereon does not have to be stripped. As shown in the drawing, the contact is of the socket type but it will be appreciated that the arrangement is equally applicable to pin contacts.

As shown in FIG. 1, the contact is made as part of a "bandolier" which facilitates automated assembly of connectors using a plurality of such contacts. On assembly, the carrying strip 1 is cut-off at or about the point

2. The contact is made of one-piece from metal strip bent into U-form for part of its length, with its base 2*a* reduced in width at the cutting point 2. This leaves a cut-out 3 in the base of the U. The cut-out portion is bent up at 90° to provide a stop 3*a* for a contact pin (not shown) mated with the socket contact.

The socket contact is formed by two spring arms 4 and 5 extending forwardly from the sidewalls 4*a* and 4*b* of the U, bent as shown in FIG. 1 to provide a contact-receiving portion. As already mentioned, the "stripless" termination is also applicable to a pin contact, in which case the arms 4 and 5 carry, or are formed to provided, such a contact.

At the rear end of the U-section portion, there are two arms 6 and 7 which extend rearwardly from the sidewalls 4*a* and 4*b* of the U. The arms bend outwards and then inwards so that their ends 6*a* and 7*a* are close together and staggered, as seen in FIG. 1. From the rear end of the base 2*a* of the U there is another extension with a bent-up end 8 which provides a wire stop.

FIG. 3 shows the ends of the arms 6 and 7 as seen in the direction of the arrow in FIG. 2. Each end 6*a* and 7*a* has two V-shaped notches such as 9 each with an extension or slot such as 10. The width of each slot is slightly less than the diameter of the core of the wire to be terminated. The two pairs of notches define apertures each of which can receive a wire to be terminated on the contact.

How the termination is effected can be seen from FIGS. 4 to 7 which relate to a contact generally similar to that of FIGS. 1 to 3, except that it only terminates one insulated wire. The contact is partially inserted into a recess 11 in a connector body 11*a*. The width of the recess is such that the U-shaped portion of the contact has an interference fit in the recess. As seen in FIG. 5, the arms 6 and 7 are initially outside the recess. The insulated wire 12 to be terminated is pushed (manually or in an automated manner) into the aperture defined by the notches 9 until its end meets the stop 8. Then the arms 6 and 7 are crimped inwardly so that the jaws close and the edges of the notches rupture the insulation on the wire and grip firmly on the core of the insulated wire.

After the jaws close on the wire, they grip it firmly in place whereafter the terminated contact is forced further into the recess 11 until it reaches the position shown in FIGS. 6 and 7. The terminated contact is now securely retained in its contact-receiving recess of the connector body 11*a*.

Figure 9:
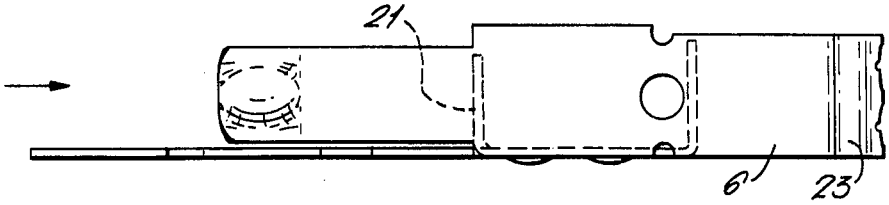
Figure 10:
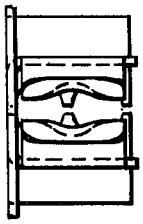
FIG. 10 is an end view of the contact-making end of the contact of FIGS. 8 and 9 looking in the direction of the arrow in FIG. 9.

The contact of FIGS. 8 to 11 is similar to the contact already described, with a few differences. Thus the contact is cut from the "bandolier" at the point 20 and the portion 21, which is trapezoidal in plan, is bent up as shown in FIG. 9 to provide a pin stop. At the other end, the wire stop 22 is further in than in the case of the earlier contact. However, the most important difference is the bend 23 in one of the arms 6. This, plus the fact that the arm 6 is not angled provide a support for the insulated wire to be terminated during the crimping.

Figure 11:
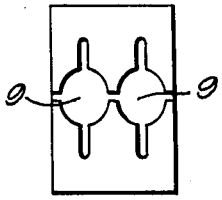
FIG. 11 is an end view showing the wire terminating end of the contact of FIGS. 8 and 9, looking in the direction of the arrow in FIG. 8.

Another difference is that the notches 9 in the crimp jaw ends are semi-circular, as can be seen from the end view in FIG. 11.

Figure 12:
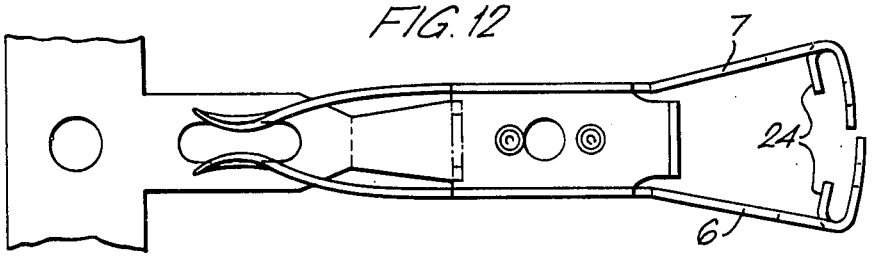
FIGS. 12 and 13 are, respectively, plan and side views of a third contact embodying the invention.
Figure 13:
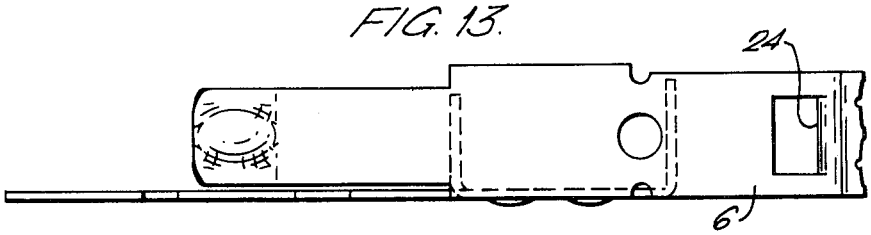

The contact shown in FIGS. 12 and 13 is similar to that of FIGS. 8 to 11 except that each of the crimp jaws has a bent up portion 24, which bears on and supports the terminated wire after it has been crimped. Another difference between this contact and that of FIGS. 8 to 11 is that the arms 6 and 7 of both crimp jaws are angled.

The closure of the jaws can be effected on single contacts by a plier-type crimp tool mounted in a simple press, in which case several such contacts can be done simultaneously. As shown, the contacts are partly inserted into the connector body with the wires between each pair of contact jaws, whereafter the crimping and final insertion take place. This can, of course, be automated. Alternatively, the contacts can be pushed into the connector body without first crimping the jaws with a tool, and the jaws will automatically close by the camming action between the outwardly bent arms 6 and 7 and the sides of the recess 11.

In all of the contacts described above, a socket contact is provided at one end of the contact. As already mentioned, a pin contact could be used instead of the socket contact. Another possibility is for the contact to have a crimp-jaw arrangement for wire termination at each end of the contact. In such case the jaws could be retained in place by a rectangular ring (not shown) surrounding the contact for each end of the contact. Such rings are pushed outwards after crimp, to hold the crimped jaws in place.

What is claimed is:

1. A stripless electrical contact comprising:

a contact body having a wire terminating end;

said body having a generally U-shaped portion forward of said wire terminating end providing a base and a pair of generally parallel, flat sidewalls;

said terminating end including a pair of arms comprising rearwardly extending extensions of said sidewalls, said sidewalls and arms being substantially perpendicular to the plane of said base, both of said arms being splayed outwardly, the end portion of each said arm being bent inwardly toward the other arm, said inwardly bent end portions of said arms each having a notch therein forming jaws, said notches defining therebetween a wire receiving aperture, whereby when an insulated wire is inserted into said aperture between said jaws and said arms are crimped together, said jaws will rupture the insulation on the wire and make electrical contact with the wire;

when said arms are crimped together said inwardly bent end portions of said arms are in contiguous parallel overlapping relationship; and each of said arms having a portion bent from it which is inboard of and parallel to said inwardly bent portions of said arms.

* * * * *